US006969065B2

(12) United States Patent
Inoue et al.

(10) Patent No.: US 6,969,065 B2
(45) Date of Patent: Nov. 29, 2005

(54) SHEET TRANSFER APPARATUS AND SHEET SUPPLY APPARATUS

(75) Inventors: Hidemi Inoue, Yamanashi-ken (JP); Satoru Matsuki, Yamanashi-ken (JP); Hidetoshi Kinoshita, Yamanashi-ken (JP)

(73) Assignee: Nisca Corporation, Yamanashi-Ken (JP)

( * ) Notice: Subject to any disclaimer, the term of this patent is extended or adjusted under 35 U.S.C. 154(b) by 310 days.

(21) Appl. No.: 10/272,908

(22) Filed: Oct. 18, 2002

(65) Prior Publication Data

US 2003/0085504 A1 May 8, 2003

(30) Foreign Application Priority Data

Oct. 19, 2001 (JP) ..... 2001-322235

(51) Int. Cl.[7] ..... B65H 5/06

(52) U.S. Cl. ..... 271/227; 271/228; 271/246; 271/266

(58) Field of Search ..... 271/242, 227, 271/226, 243, 246, 245, 268, 273, 266, 228

(56) References Cited

U.S. PATENT DOCUMENTS 4,485,949 A * 12/1984 Gebhart et al. ..... 226/2
4,558,373 A * 12/1985 Plasencia et al. ..... 358/484
5,078,384 A * 1/1992 Moore ..... 271/228
5,253,862 A * 10/1993 Acquaviva et al. ..... 271/251
5,368,285 A 11/1994 Kusumoto
5,494,277 A 2/1996 Flores
5,596,399 A * 1/1997 Dempsey et al. ..... 399/45
5,645,273 A * 7/1997 Nakagawa et al. ..... 271/10.1
5,692,744 A * 12/1997 Funato ..... 271/242
5,775,690 A * 7/1998 Quesnel et al. ..... 271/242
6,338,483 B1 * 1/2002 Andela et al. ..... 271/227
6,712,357 B1 * 3/2004 Tranquilla ..... 271/273

FOREIGN PATENT DOCUMENTS

JP 11-30884 2/1999
JP 11030884 A * 2/1999 ..... G03G 15/00

* cited by examiner

*Primary Examiner*—Patrick Mackey
(74) *Attorney, Agent, or Firm*—Manabu Kanesaka

(57) ABSTRACT

A sheet transport apparatus includes the first transport rollers, the second transport rollers arranged at downstream of the first transport rollers to receive a sheet transported from the first transport rollers, a spacing device for setting the first transport rollers to a sheet nipping state or a sheet released state, a sheet detection device for detecting a sheet length in a transport direction, and a comparing device for comparing the sheet length detected by the sheet detection device with a predetermined length. It is controlled such that the spacing device is activated to switch the first transport rollers from a sheet nipping state to a sheet released state after the sheet is transported by a predetermined distance when the sheet length is longer than the predetermined length, and to maintain the first transport rollers in the sheet nipping state when the sheet length is shorter than the predetermined length.

7 Claims, 16 Drawing Sheets

SHEET TRANSFER APPARATUS AND SHEET SUPPLY APPARATUS

BACKGROUND OF THE INVENTION AND RELATED ART STATEMENT

The present invention relates to a sheet supply apparatus and a sheet transport apparatus mounted to an image forming apparatus (referred to an image forming apparatus), such as a copier, printer apparatus or a facsimile machine. More particularly, the present invention relates to an automatic supply apparatus detachably mounted to an image forming apparatus and having aligning means for supplying sheets to an image forming apparatus while aligning an edge of the supplied sheets to an alignment reference member.

An image forming apparatus is equipped with a supply portion to supply stacked sheets and image forming means to form images or characters on the sheets supplied from the supply portion. The sheets are transported from the sheet supply portion to the image forming means in a sheet transport path disposed in the image forming apparatus.

In the image forming apparatus, in order to improve the image forming quality by forming the images on predetermined positions on the sheets, the image forming apparatus is equipped with aligning means to supply the sheets to the image forming means while aligning an edge of the sheets supplied from the sheet supply portion to accurately position the sheets. Examples of the image forming apparatus equipped with such aligning means are disclosed in Japanese Patent Publication No. 08-208078 and U.S. Pat. No. 5,494,277.

Apparatuses disclosed in the publications have internal cassette trays for storing the sheets inside the image forming apparatus, and are configured to supply the sheets stacked in the cassette trays to the image forming portion. The number of the sheets stored in the cassette trays is normally approximately from 250 to 500. Thus, when forming an image for a large volume of the sheets at a high speed, it is necessary to frequently replenish sheets. For that reason, an automatic sheet supply apparatus has been required to store a large volume of the sheets.

As shown in Japanese Patent No. 2,625,057 and U.S. Pat. No. 5,368,275, the automatic sheet supply apparatuses with a large capacity are equipped with an elevating paper deck (support stage) for supporting a large volume of stacked sheets (generally from 2,000 to 3,000 sheets), and separating supply means for separating the sheets stacked on the paper deck into a single sheet and for supplying the sheet to a resister roller on the image forming apparatus.

Also, disclosed in Japanese Patent Publication No. 11-30884 as an example, an apparatus installed in the image forming apparatus is configured such that relay rollers arranged at an upstream side in the transport path are separated after the sheet reaches transport rollers at a downstream side to reduce a transport load on the rollers at the downstream side in the transport path when transporting the sheet. One of the rollers is attached to a swinging lever, and a solenoid moves the lever to separate the pair of the relay rollers.

However, there are several problems associated with mounting the conventional large capacity automatic sheet supply apparatus to an image forming apparatus equipped with the aforementioned aligning means.

Firstly, after the sheets from the automatic sheet supply apparatuses reach the alignment means on the image forming apparatus, they are moved in a direction traversing the sheet transport direction along the transport reference. However, when the sheets are nipped in the separating supply means, the sheets are not smoothly moved to the sheet transport reference side. Particularly, in a case that the transport force of the alignment means increases, the sheets might overrun the transport reference, or in the case of thin sheets, their edges might be bent. Further, when the separating supply means remains in a pressing state, it is substantially impossible to do the alignment.

Secondly, it is conceivable to move the sheet transport reference or the alignment means on the sheet automatic sheet supply apparatus to the image forming apparatus side. However, in this case, it is unavoidable to increase a size of the sheet supply apparatus.

Thirdly, the aforementioned sheet supply apparatus needs to have the aligning means since the image forming apparatus performs resister correction for aligning the leading edge of the sheets after separated and supplied, thereby increasing the size of the image forming apparatus. For that reason, if the resister means is eliminated, only the aligning means corrects the sheets, and it is difficult to perform the proper aligning correction for sheets with large bends.

OBJECT OF THE INVENTION

The first object of the present invention is to provide a sheet transport apparatus and a sheet supply apparatus that can securely align the sheet reference position with aligning means even if mounted to an image forming apparatus equipped with the aligning means.

The second object of the present invention is provide a sheet transport apparatus and a sheet supply apparatus with high speed sheet supply capability through eliminating unnecessary movement and appropriate control for action of the pair of the rollers in a sheet nipping state and a sheet released state necessary for feeding the sheets to the aligning means according to a length of the transported sheets.

The third object of the present invention is to provide an apparatus that can combine an image forming apparatus with the aligning means and a sheet supply apparatus, and to provide a compact apparatus that can perform resister correction with the sheet supply apparatus in advance.

SUMMARY OF THE INVENTION

In order to attain the aforementioned objectives, the present invention provides a sheet transport apparatus that comprises the first transport rollers; the second transport rollers arranged at a downstream side of the aforementioned first transport rollers to receive a sheet transported from the aforementioned first transport rollers; spacing means for setting the aforementioned first transport rollers to a sheet nipping state or to a sheet released state; sheet detection means for detecting a sheet length in a transport direction of transported sheets; and comparing means for comparing the sheet length detected by the aforementioned sheet detection means with a preset sheet length. The sheet transport apparatus is controlled to activate the aforementioned separating means to activate the aforementioned first transport rollers from a sheet nipping state to a sheet released state after the aforementioned sheet is transported by a predetermined distance when the result of the comparison indicates that the aforementioned sheet length is longer than the aforementioned predetermined length, and is controlled to activate the aforementioned separating means to maintain the aforementioned first transport rollers in a sheet nipping state when the aforementioned sheet length is shorter than the aforementioned predetermined length.

With the configuration described above, the invention provides the apparatus that is easy to align the sheets at downstream and eliminates unnecessary operations to perform high speed sheet transport and sheet supply because it can control to activate the transport rollers from the sheet nipping state to the sheet release state or to maintain the sheet nipping state according to a length of the sheet transported. For that reason, the aforementioned predetermined length is set based on a distance from the aforementioned first transport rollers to the aforementioned second transport rollers. After the transported sheet is supplied to the aforementioned second transport rollers, the aforementioned first transport rollers are activated to switch from the sheet nipping state to the sheet released state.

Also, the present invention provides an automatic sheet supply apparatus detachably mounted to an image forming apparatus for drawing and supplying stacked sheets. The automatic sheet supply apparatus includes separating means for separating the sheets in a sheet transport path; a pair of relay rollers for transporting the sheets from the separating means to sheet transport rollers in the image forming apparatus; release means for reducing or releasing a pressure on the aforementioned sheet transport rollers from the sheets; sheet detection means for detecting a length of the sheet in the transport direction; and comparing means for comparing the sheet length detected by the aforementioned sheet detection means with a predetermined length. It is controlled to determine whether to activate the aforementioned release means according to a result of the comparing means.

When the result of the comparison of the lengths indicates that the sheet length is longer than the predetermined length, after transporting the sheet by a specific distance, the spacing means is activated to switch the first transport rollers from the sheet nipping state to the sheet released state. When the sheet length is shorter than the predetermined length, the first transport rollers are controlled to maintain the sheet nipping state. For this reason, the predetermined length is set based on a distance from the first transport rollers to the second transport rollers. After the transported sheet is supplied to the second transport rollers, the first transport rollers are switched from the sheet nipping state to the sheet released state.

Furthermore, the present invention provides an automatic sheet supply apparatus for supplying sheets to an image forming apparatus having sheet aligning means for aligning the sheets at a predetermined sheet transport reference in the sheet transport direction. The automatic sheet supply apparatus includes ascending and descending sheet storage means for storing stacked sheets; sheet pick-up means for picking-up out the sheets from the sheet storage means; separation means having supply rollers for supplying the sheets picked-up from the sheet pick-up means and a separating member for pressingly touching the supply rollers; a pair of relay rollers for transporting the sheets separated by the separation means toward downstream in the sheet supply path in the transport direction; the first drive means having the first spacing means for rotating the supply rollers in the sheet supply direction with a forward direction rotation and for setting the supply rollers to a sheet nipping state or to a sheet released state with a reverse direction rotation; the second drive means having the second spacing means for rotating the pair of the relay rollers in the sheet supply direction with a forward direction rotation and for setting the pair of the relay rollers to a sheet nipping state or to a sheet released state with a reverse direction rotation; sheet detection means for detecting a length of the sheet in the transport direction; memory means for storing transport distance data from the pair of the relay rollers to where the sheets can be transported by the sheet aligning means; and comparing means for comparing the sheet length detected by the sheet detecting means with the transport distance date. It is controlled to determine whether to switch the second drive means from a forward direction rotation to a reverse direction rotation based on the comparison results of the aforementioned comparing means.

Here, when the results of the comparison determines that the sheet length is longer than the transport distance data, the second spacing means activates the pair of the relay rollers to switch from the sheet nipping state to the sheet released state. Conversely, when the sheet length is shorter than the predetermined length, the pair of the relay rollers maintains the sheet nipping state. Therefore, it is easy to securely align the sheets, and unnecessary operations are eliminated, thereby enabling high speed sheet supply.

DETAILED DESCRIPTION OF PREFERRED EMBODIMENTS

Below, an explanation of the preferred embodiments of the image reading apparatus equipped with a sheet supply apparatus according to the present invention will be provided in detail based on the accompanying drawings.

Figure 1A:
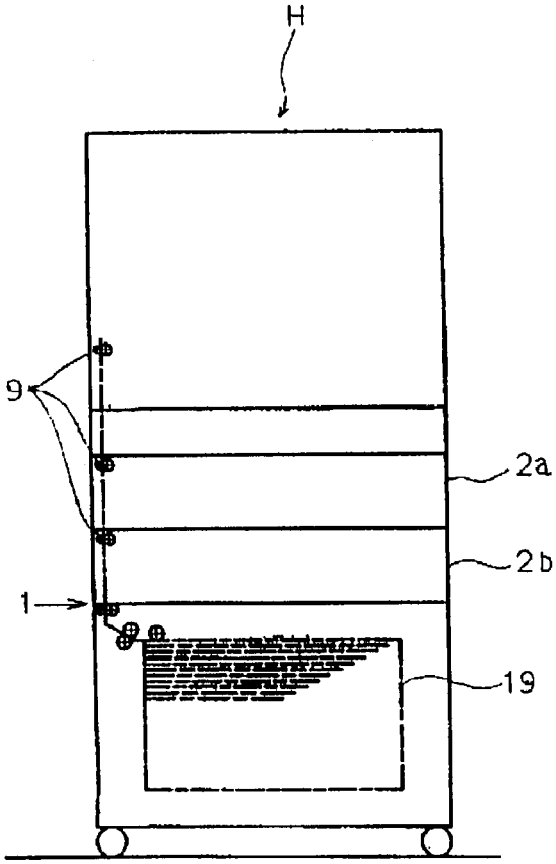
FIGS. 1(*a*) and 1(*b*) are views showing a sheet supply apparatus in a sheet feeding position installed in an image forming apparatus such as a copier.
Figure 1B:
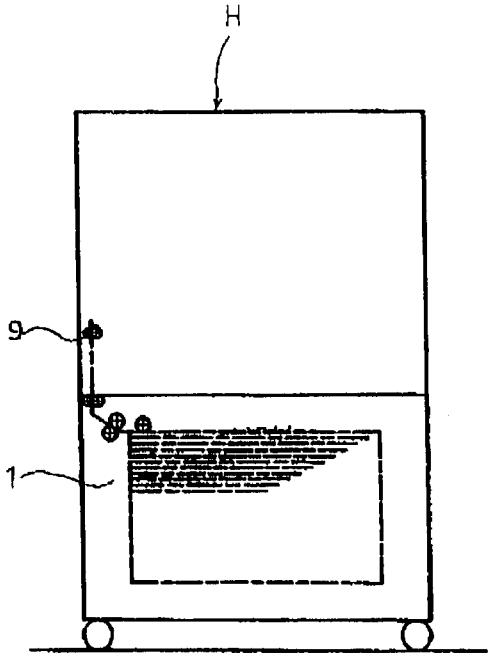
Figure 2:
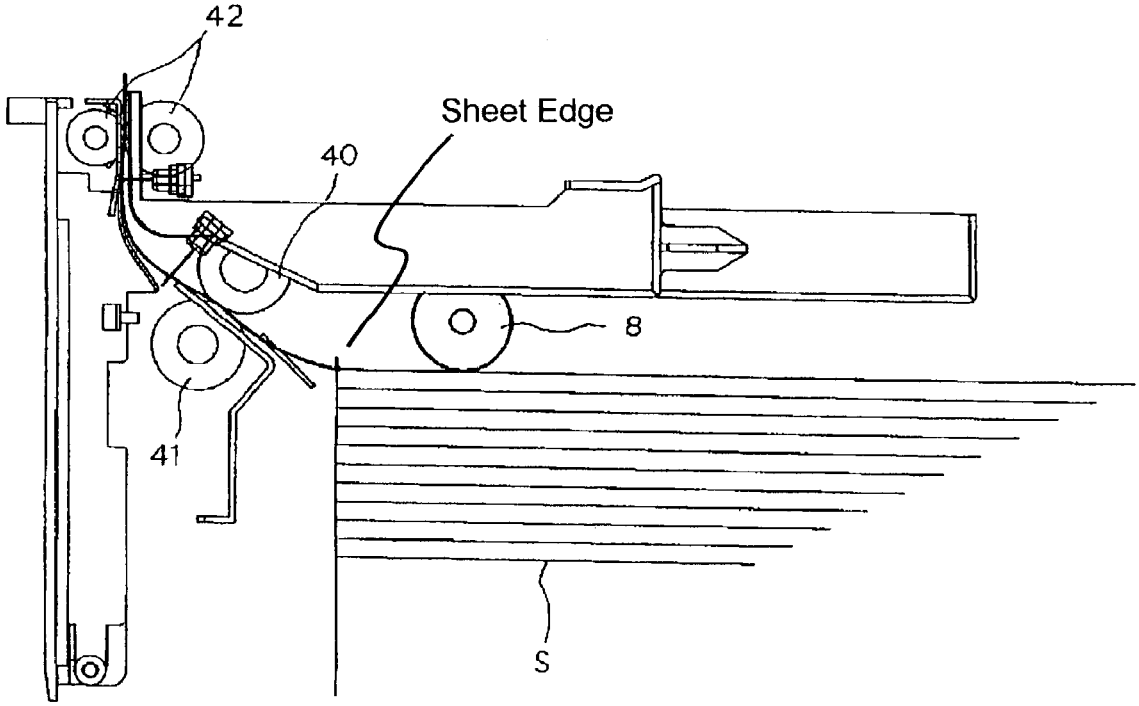
FIG. 2 is a view showing a state that sheet supply means in the sheet supply apparatus of the present invention separates stored sheets into a single sheet and supplies the sheet.

FIG. 1(*a*) and FIG. 1(*b*) show examples of the sheet feeding apparatus in the sheet supply position, stored in an image forming apparatus (copy machine) H. FIG. 2 is a drawing showing a sheet stored in the sheet supply apparatus 1 being fed one at a time to a printer by the sheet supply means such as the pick-up rollers 8.

The image forming apparatus H is printer comprising a laser scanner that scans laser light according to the image information on the upper portion of the apparatus unit H, an image processing unit, transfer rollers, fixer (neither being shown in the drawings) and the transport rollers 9. Also, below the apparatus main unit H is formed the sheet supply apparatus 1. The sheets S stored in the sheet supply apparatus 1 and 2 are configured to be transported by the transport means that include the pick-up rollers 8 as shown in FIG. 2, to the aforementioned printer under a predetermined timing.

FIG. 1(*a*) shows the configuration with a plurality of sheet supply apparatuses 1, 2*a* and 2*b* disposed on the image forming apparatus H. Each of the sheet supply apparatus 1, 2*a* and 2*b* is configured to function independently. The sheet supply apparatus comprises the sheet size detection means and can stack a variety of sheet sizes. It is possible to allot fixed sizes of sheets to the sheet supply apparatuses 2*a* and 2*b* for use.

Also, FIG. 1(*b*) shows the image forming apparatus H configured with only the sheet supply apparatus that comprises the sheet size detection means and can stack a variety of sheet sizes. The image forming apparatus H is more compact in comparison to that shown in FIG. 1(*a*) because it supplies sheets only with the sheet supply apparatus 1 that can stack a plurality of sheets sizes.

Also, the plurality of sheet supply apparatus 1, 2*a* and 2*b* are detachably mounted to the image forming apparatus H, so it is possible to configure for only the apparatus shown in FIG. 1(*b*) when using a large volume of sheets having the same sizes, or to use the apparatus shown in FIG. 1(*a*) when often using other sizes.

This shall describe the configuration and operations of the sheet supply apparatus 1 according to the preferred embodiment. The sheet supply apparatus 1 comprises the sheet storage means (sheet storage cassette) 19, the sheets support stage 7 established in the sheet storage means 19, the support means 30 that movingly supports the sheet storage means 19 in the transport path between the sheet replenishing position and the sheet supply position, the frame 10 on one side of the support means 30 that fastens this, the pick-up rollers 8 that separate sheets into single sheets and feed them from the sheet storage means 19 at the sheet supply position, and the sheet supply means such as the supply rollers 40, the separation rollers 41 which are the separating members and the paired resister rollers 42.

Also, in the sheet storage means 19 are established the sheet regulating means and the trailing edge support guide 5, not shown in the drawings, that regulate the width direction of the sheets.

Also, the sheet supply apparatus 1 is composed of the sheet size detecting means 20 that detects the size of the sheets stored in the sheet storage means 19 in cooperation with the trailing edge support guide 5.

Figure 3:
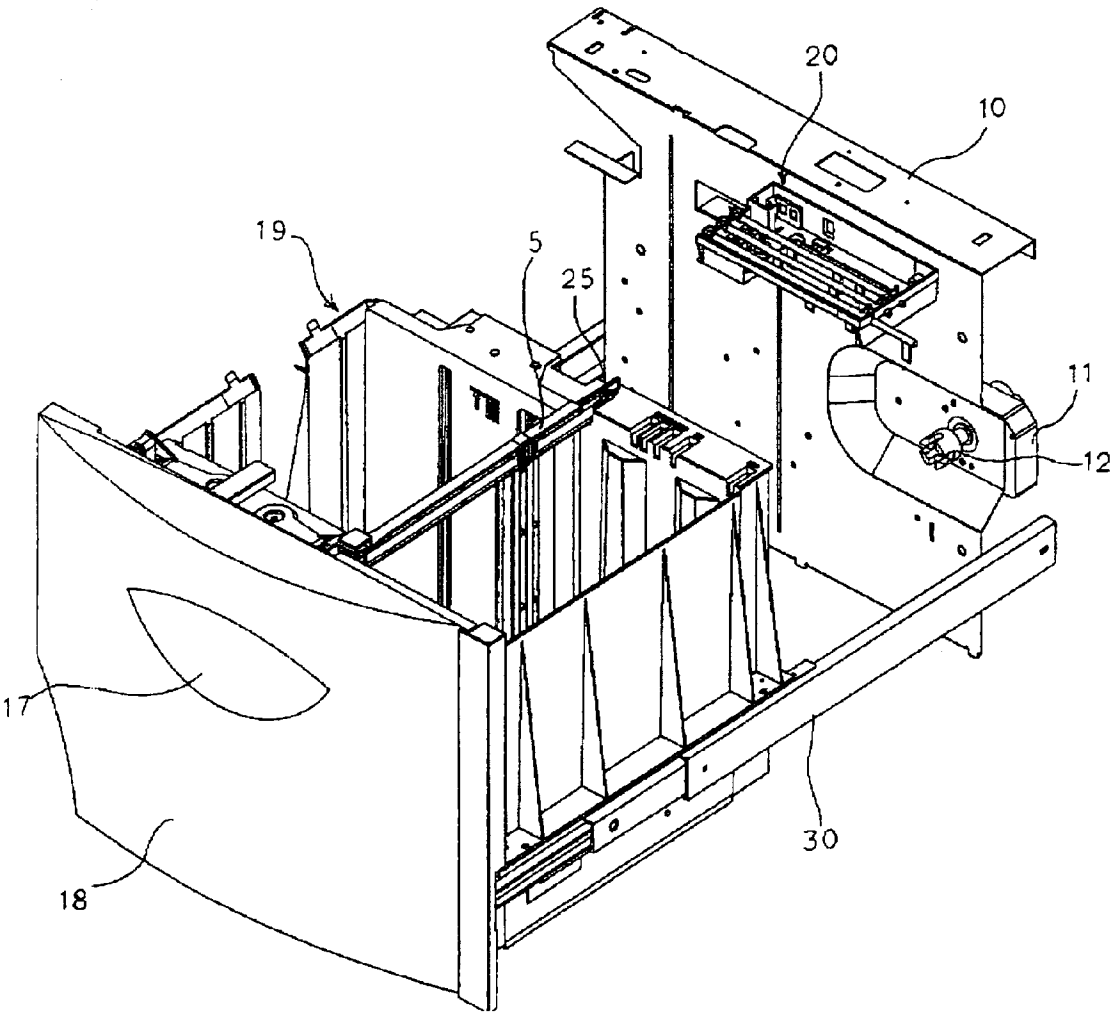
FIG. 3 is a perspective view showing a state that the sheet supply apparatus is pulled out from a frame of the image forming apparatus and in a sheet replenishment position.

FIG. 3 is a perspective view showing the sheet supply apparatus 1 pulled out from the frame 10 in the image forming apparatus H to the sheet replenishment position.

The sheet storage means 19 (cassette) can be moved to the sheet replenishment position by holding the handle 17 established in the front cover 18 on the sheet storage means 19 stored in the frame 10 and pulling toward yourself. In this movement, the support rail which is the support means 30 that supports the sheet storage means 19 is configured to expand and retract. One end of the support means 30 is fastened to the frame.

The sheet storage means 19 is pulled out to the sheet replenishment position guided on the support rails of the support means 30. Sheets can be stored in the sheet storage means 19 when it is pulled out from the frame 10. At this time, the sheet size detecting means 20 and the lift up drive means coupling 12 established on the frame separate from the sheet storage means 19.

The space created between the frame 10 and the sheet storage means 19 when the sheet storage means 19 is pulled out to the sheet replenishment position is the sheet storage means 19 transport path.

Figure 4:
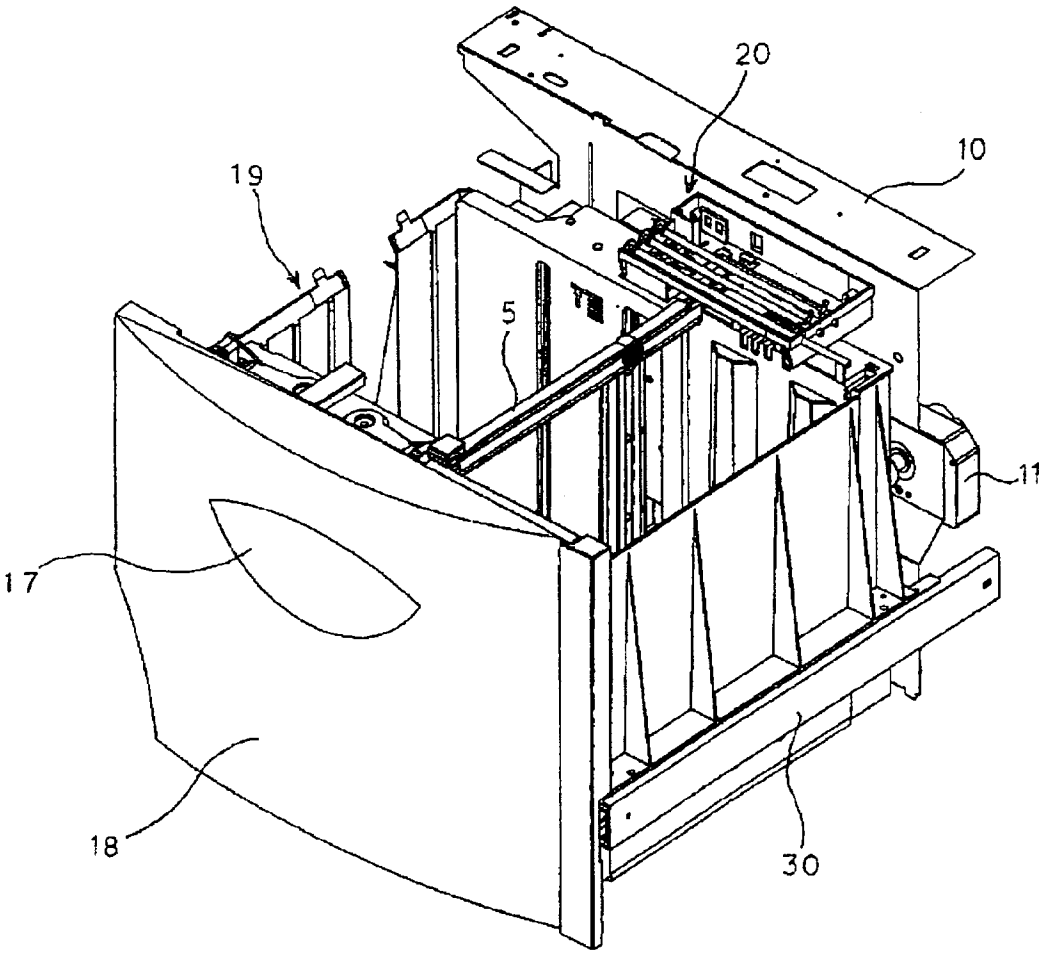
FIG. 4 is a perspective view showing a state that the sheet supply apparatus is in the sheet supply position in the frame of the image forming apparatus.

FIG. 4 is a perspective view showing the sheet supply apparatus at the sheet supply position in the frame on the image forming apparatus.

The sheet storage means 19 movement to the sheet supply position is performed by pushing the front cover 18 on the sheet storage means 19 when it is in the sheet replenishment position to push the sheet storage means 19 into the frame on the main unit.

When pushing the front cover on the sheet storage means 19 to push the sheet storage means 19 into the main unit frame, the support rail on the support means 30 that supports the sheet storage means 19 retracts and the sheet storage means 19 moves to the sheet supply position.

The sheet size detecting means 20 is established at the position in the transport path in the frame. For that reason, when the sheet storage means 19 is pushed in and is positioned at the sheet supply position, the sheet size detecting means is arranged in a position overlapping the sheet storage means 19 looking from the sheet stacking direction.

At that time, the lever pressing portion 25 established on one side of the sheet trailing edge support guide 5 is configured to one or a plurality of detection lever contact portions formed on one or a plurality of size detection levers on the sheet size detecting means 20. Also, as a drive transmission means for elevating the sheets support stage 7, the coupling 12 is mated to the pin 14 for the coupling established on the sheet storage means 19.

Figure 5:
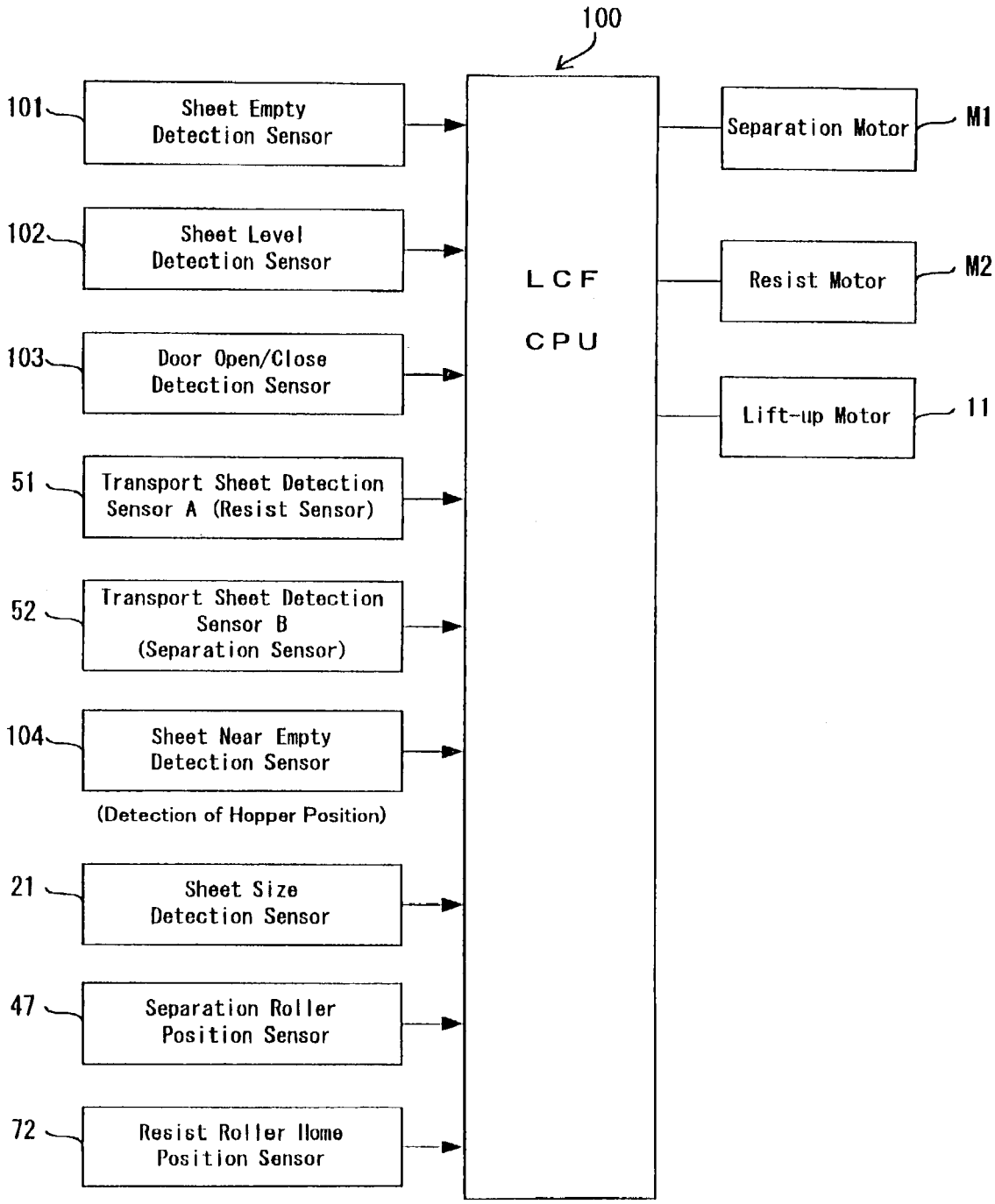
FIG. 5 is a block diagram showing a configuration of a control mechanism of the image forming apparatus and sheet supply apparatus.

FIG. 5 is a block drawing showing the configuration of the control mechanism for the image forming apparatus and sheet supply apparatus according to the present invention. The control system of the sheet supply is composed of the CPU 100 to store the programs and data and to control each apparatus, and each of the sensors of the sheet empty detection sensor 101 connected to the CPU 100 that detects sheet transport data and sends that detected data to the CPU, the sheet level detection sensor 102, the door open/closed detection sensor 103, the transport sheet detection sensor A (resister sensor 51), the transport sheet detection sensor B (separation sensor 51), the sheet near empty detection sensor 104, the sheet size detection sensor 21, the separation roller home position sensor 47 and the resister roller home position sensor 72.

Furthermore, connected to the CPU 100 are the separation motor M1 that applies the drive for the separation rollers to separate and press together and the drive to transport sheets using the separation rollers, the resister motor M2 that applies the drive for the resister rollers to separate and press together and the drive to transport sheets using the resister rollers, and the lift-up motor M11 for elevating the hopper that stacks sheets.

Figure 6A:
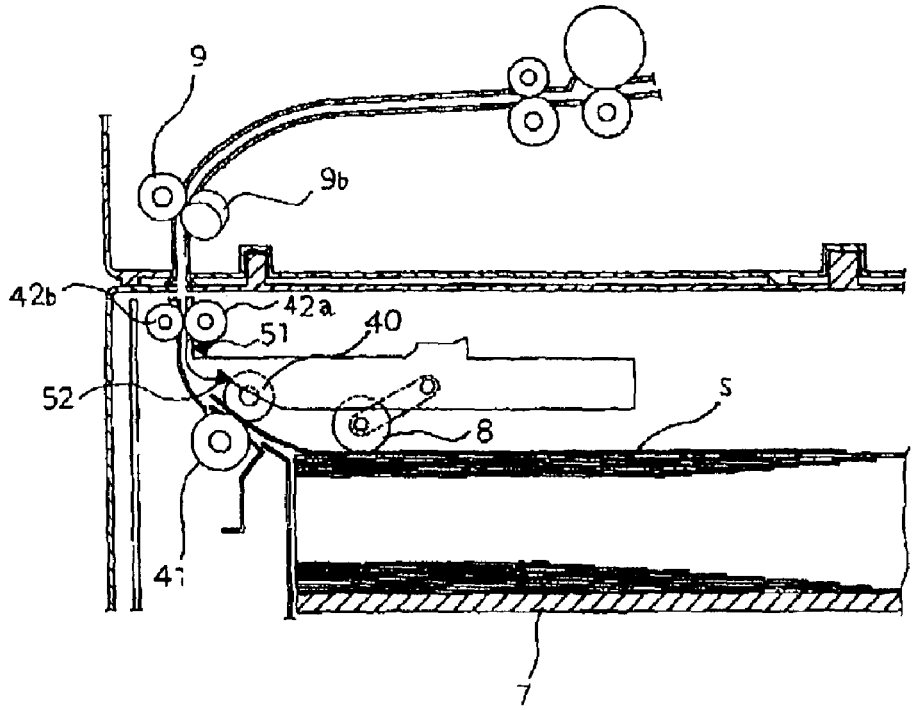
FIG. 6(*a*) and FIG. 6(*b*) are sectional views showing a state that the sheet supply apparatus is mounted on a lower level of the image forming apparatus, and showing a state (No.1) that the sheet is supplied until resister rollers 42 perform resister correction.
Figure 6B:
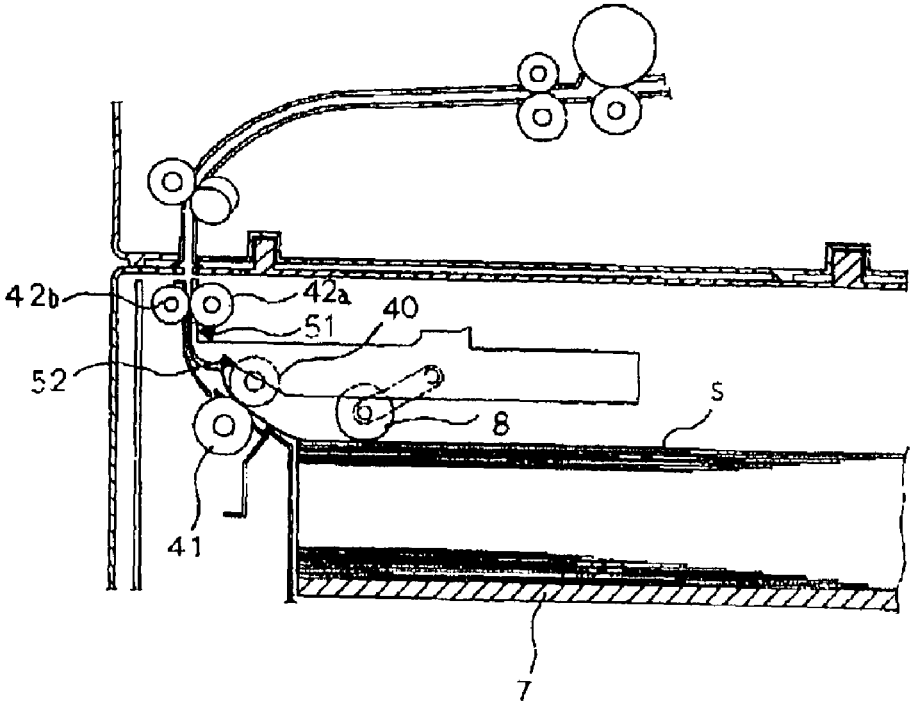

FIG. 6(*a*) and FIG. 6(*b*) are sectional views of the sheet supply apparatus mounted on the lower level of an image forming apparatus unit showing a sheet being fed (No. 1). FIG. 6(*a*) shows the pick-up rollers 8 picking-up a sheet stacked in the sheet storage means 19 on the sheet supply apparatus 1 and being fed to the supply rollers 40 and the separation rollers 41. The sheets S stacked in the sheet storage means 19 are lifted up and stopped at the idle position. When the supply signal is received from the main unit, sheet supply is started.

The sheets S stacked in the sheet storage means 19 is raised from the idle position and touched to pick-up rollers 8 which transport the sheets S to the sheet supply roller 40 and paired separation rollers 41. At this time, the sheet supply rollers 40 and the paired separation rollers 41 nip the sheet. The paired separation rollers 41 comprise the function of separating sheets into single sheets.

FIG. 6(*b*) shows sheets supplied by the sheet supply rollers 40 and the paired separation rollers 41 to touch the resister rollers 42 and being aligned. The sheet S having been separated into a single sheet passes the resister sensor, and is stopped once at the paired resister rollers 42 where it is aligned, then sent to the transport rollers 9 on the image forming apparatus main unit side. At this time, the sheet supply rollers 40 and the paired separation rollers 41 nip the sheet.

Figure 7A:
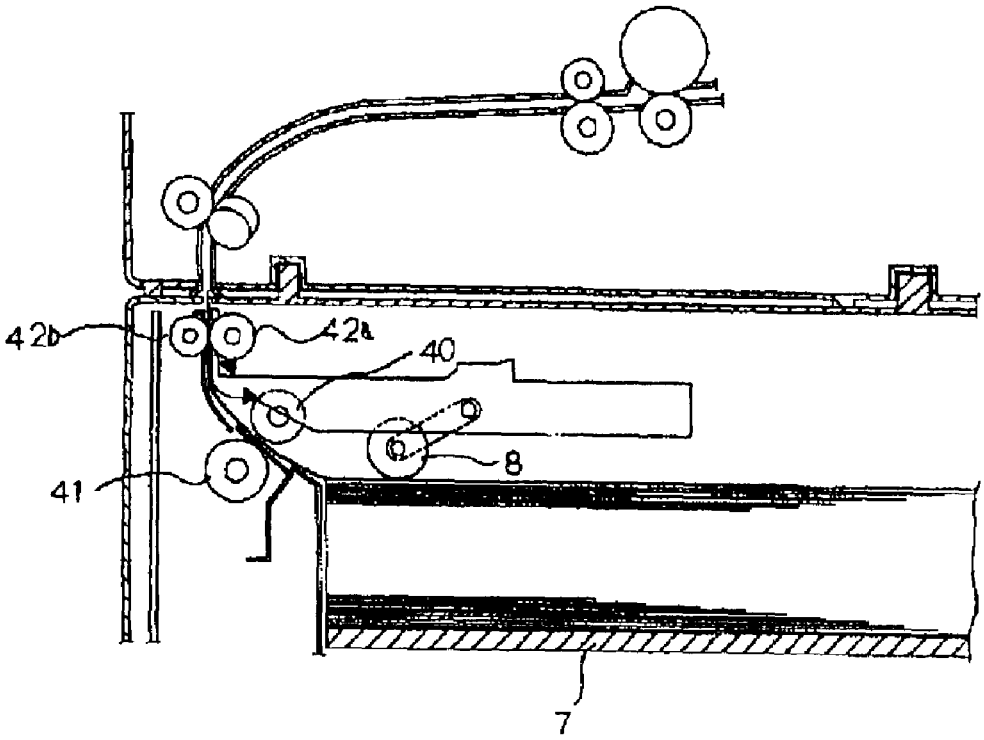
FIG. 7(*a*) and FIG. 7(*b*) are views showing a state (No. 2) that the sheet is supplied until main unit aligning rollers nip the sheet, continued from FIGS. 6(*a*) and 6(*b*)
Figure 7B:
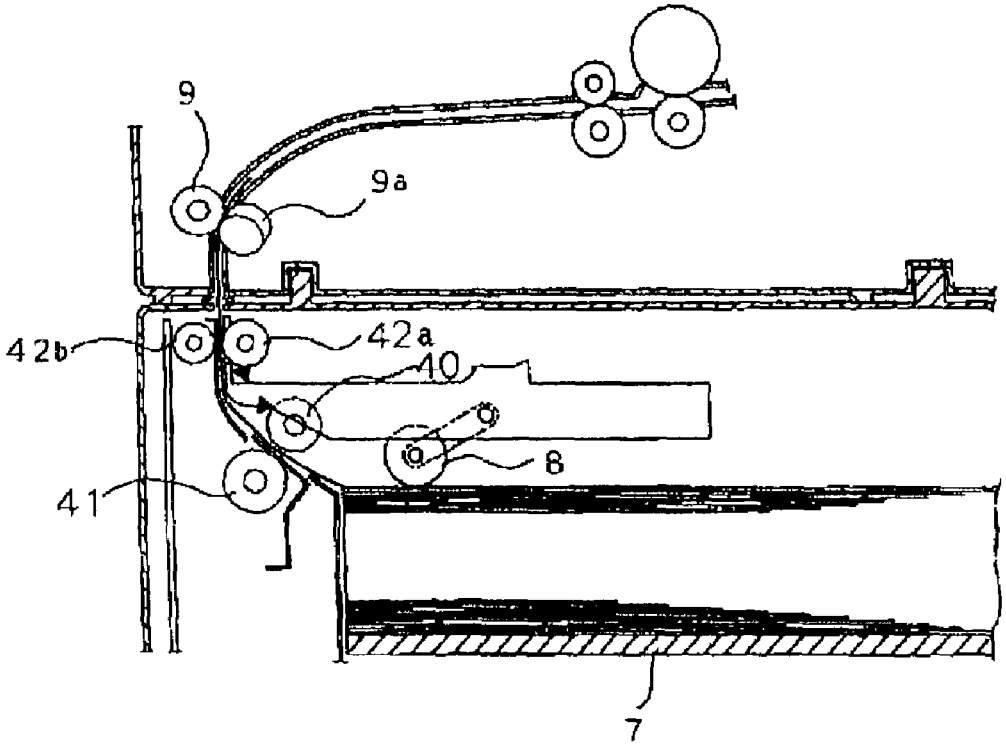

FIG. 7(*a*) and FIG. 7(*b*) show the sheet supply status in continuation from the drawings of FIG. 6(*a*) and FIG. 6(*b*) (No. 2). FIG. 7(*a*) shows the sheet being nipped by the paired resister rollers 42 and being transported to the main unit apparatus. The sheet having been aligned in front of the paired resister rollers 42 is nipped by the paired resister rollers 42 and when it proceeds a predetermined distance, the sheet supply rollers 40 and the separation roller 41 separate. The reason for the separation is so that the aligned sheet does not bend. FIG. 7(*b*) shows the sheet transported from the paired resister rollers 42 nipped by the transport rollers 9 on the main unit side and alignment rollers 9*b* and being sent by the alignment rollers 9*b* while one side is against the sheet supply reference. When in this state, the paired resister rollers 42 separate. The sheet supply rollers 40 and the paired separation rollers 41 also separate. In this way, the sheet is sent along the sheet supply reference without skewing while being transported against the reference while each of the rollers is separated.

Figure 8A:
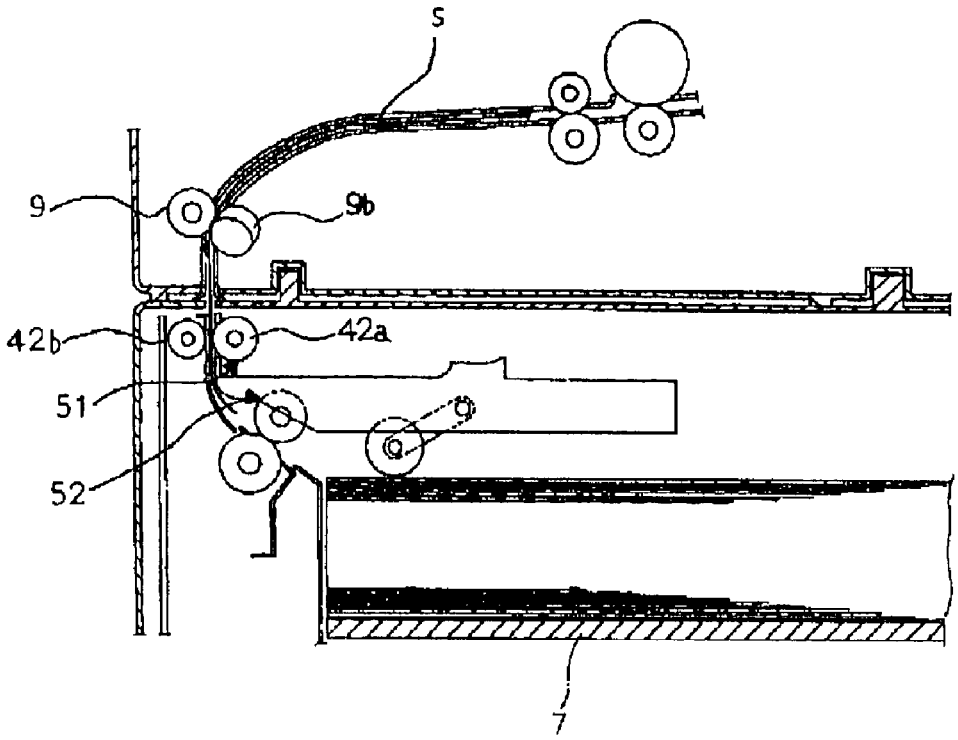
FIG. 8(*a*) and FIG. 8(*b*) are views showing a state (No. 3) that the sheet is supplied from a trailing edge of the sheet passes separation rollers 41 until the trailing edge of the sheet passes the resister rollers 42, continued from FIGS. 7(*a*) and 7(*b*)
Figure 8B:
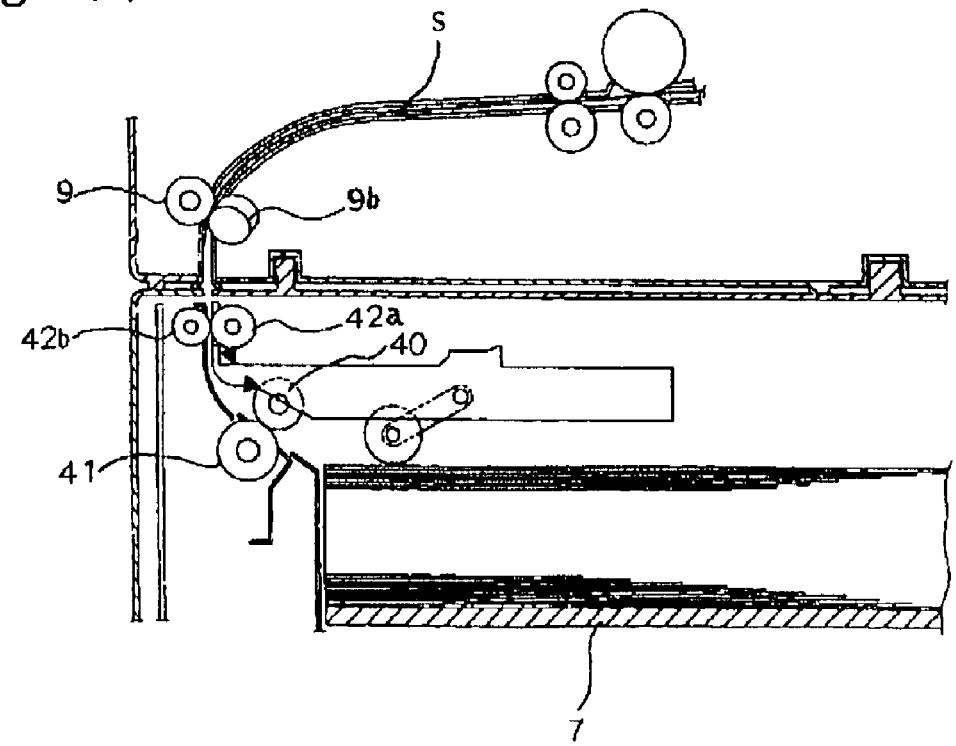

FIG. 8(*a*) and FIG. 8(*b*) show the sheet supply status in continuation from the drawings of FIG. 7(*a*) and FIG. 7(*b*) (No. 3). FIG. 8(*a*) shows the transported sheet trailing edge passing the separation sensor 52. When the trailing edge of the sheet passes the separation sensor 52, the sheet supply rollers 40 and the paired separation rollers 41 are pressed together (nip) to prepare for the next sheet to be supplied. As the sheet S that is being transported passes the paired resister rollers 42, the paired resister rollers 42 are in a separated state. FIG. 8(*b*) shows the transported sheet trailing edge passing the resister sensor 51. The transported sheet trailing edge passes the resister sensor 51, is transported a predetermined distance and when it passes the paired resister rollers 42 the paired resister rollers 42 press together (nip) . Here, the sheet supply rollers 40, paired separation rollers 41 and the paired resister rollers 42 are ready to accept the next sheet that is sent.

The following shall describe the configuration of the pressing and separating drive mechanism for the sheet supply rollers 40 and the paired separation rollers 41 which are the first spacing means according to embodiment of the present invention.

Figure 9A:
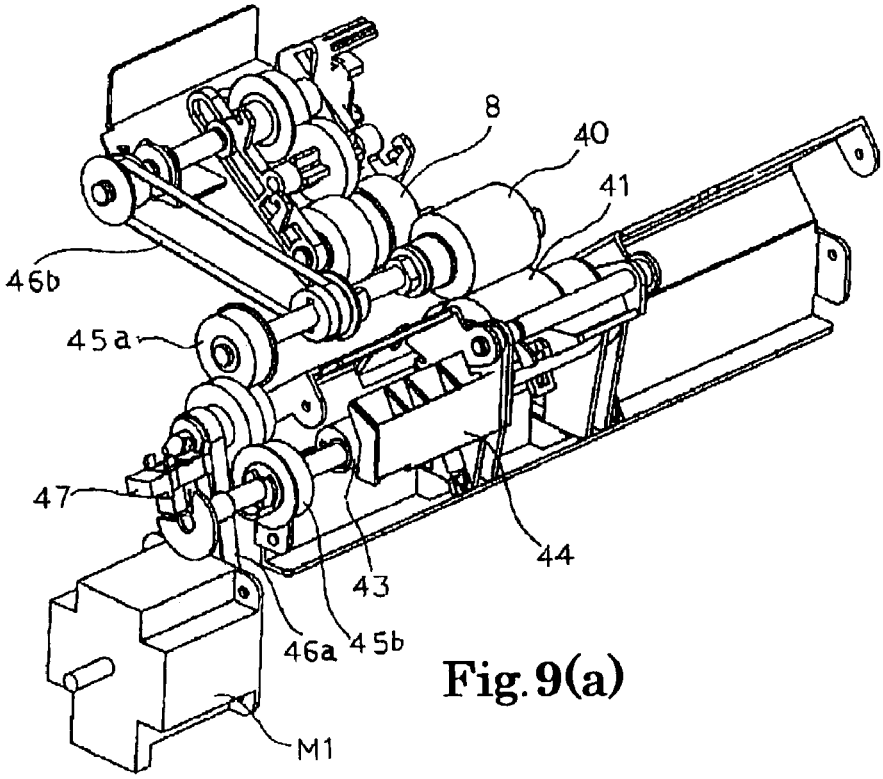
FIG. 9(*a*) and FIG. 9(*b*) are perspective views showing a sheet separating drive mechanism of the sheet supply apparatus according to the present invention.
Figure 9B:
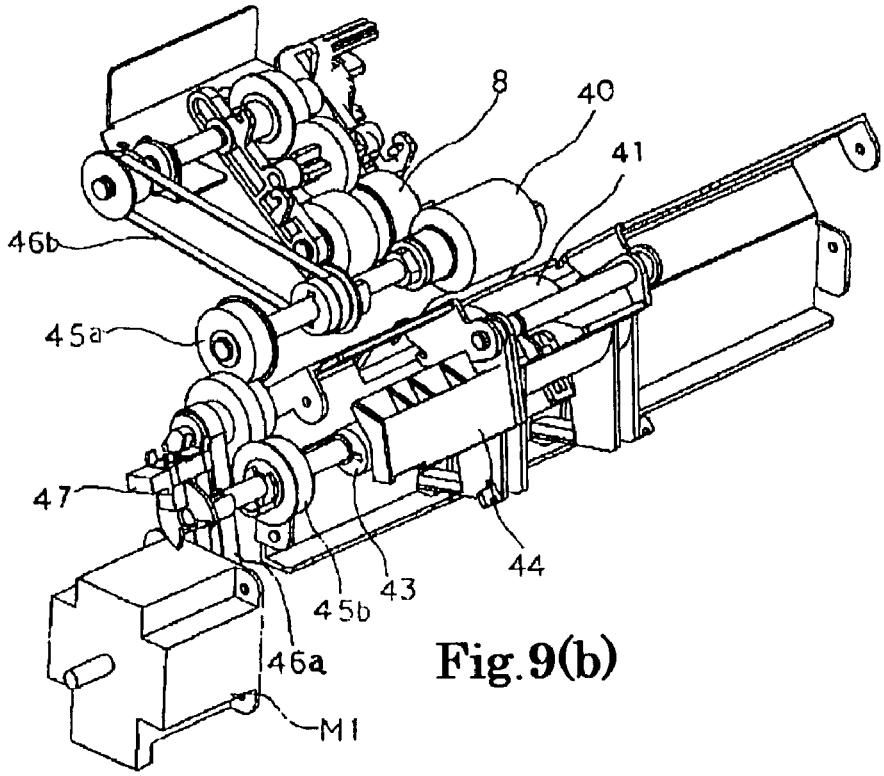

FIG. 9(*a*) and FIG. 9(*b*) are perspective views of the mechanism for the sheet supply means in the sheet supply apparatus 1. The sheet supply means is composed of the pick-up rollers 7 that transport the uppermost sheet S of the sheets stacked in the sheet storage means 19, the sheet supply roller 40 that transports the sheets S supplied from the pick-up rollers 7 to the paired resister rollers 42, the separation rollers 41 opposed to the sheet supply roller 40, that separate sheets into single sheets, the separation roller support member 44, the eccentric cam 43 for separating the separation rollers 41 from the supply roller 40, the one-way clutches 45*a* and 45*b* that transmit rotational drive force to the pick-up rollers 7, sheet supply roller 40, and the separation roller 41, and the belts 46*a* and 46*b* that transmit the drive force of the motor M1.

FIG. 9(*a*) shows the sheet stacked in the sheet storage means 19 being sent to the supply roller 40 by the pick-up roller 7, the sheet supply roller 40 and the separation roller 42 pressing together to separate the sheets into single sheets for transport. At this time, the eccentric cam 43 separates from the separation roller support member 44 to turn the sensor 47 on.

FIG. 9(*b*) shows the sheet transported a predetermined distance from the supply roller 40 to the resister rollers, and the rotated drive eccentric cam 43 presses the separation roller support member 44, thereby separating the supply roller 40 and separation roller 42. By separating the supply roller 40 and the separation roller 42, a second sheet is not supplied until the first sheet has been completely transported and separated from the roller 40. At this point, the sensor 47 turns off.

Figure 10:
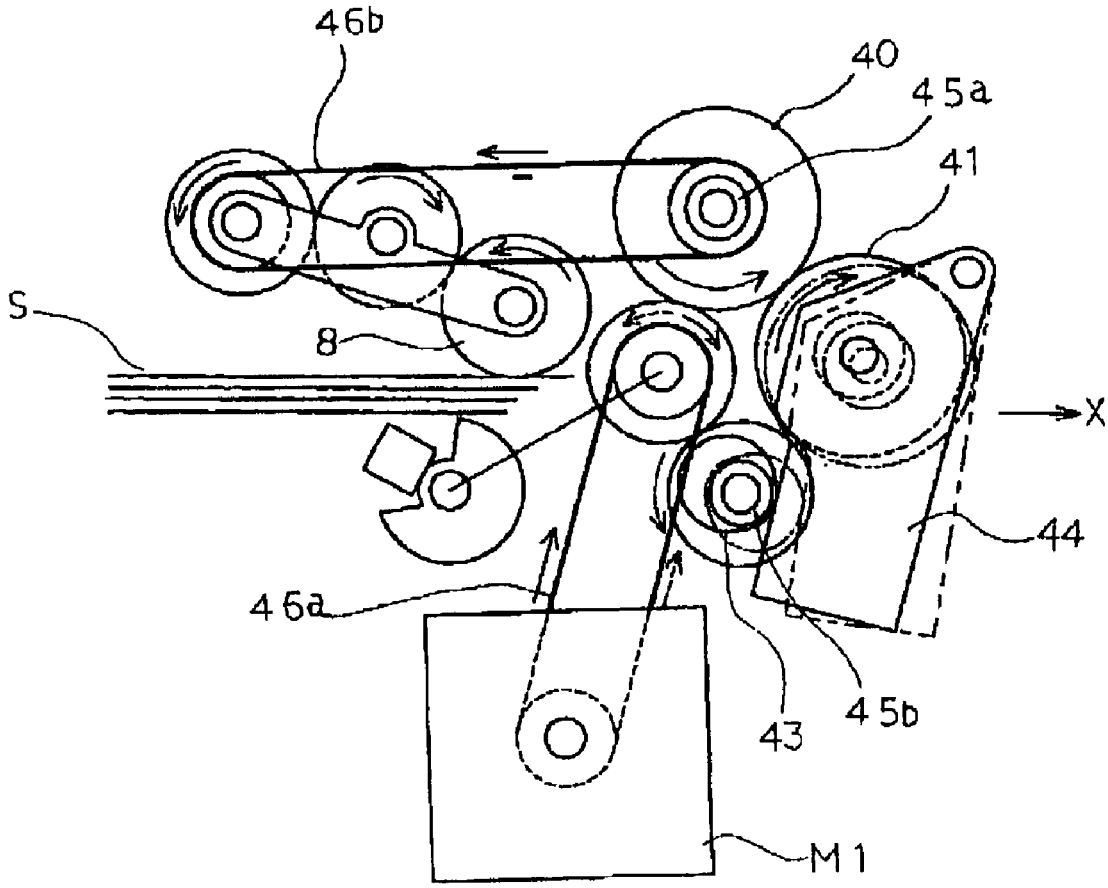
FIG. 10 is a view showing a configuration of a separating mechanism of supply rollers and the separation rollers in the sheet supply apparatus according to the present invention.

FIG. 10 shows the configuration of the supply roller 40 and separation roller 41 separating mechanism. The sheet S having been aligned in front of the paired resister rollers 42 is nipped by the paired resister rollers 42 and when it proceeds a predetermined distance, the supply roller 40 and the separation roller 41 are separated. The separation operation is described below. The leading edge of the sheet S passes the resister sensor 51 and touches the resister rollers 42 to be aligned. The sheet S stops once there. At this point, the motor M1 stops to stop the separation roller 41. Next, the sheet is nipped by the resister rollers 42 and transport is started. When the leading edge of the sheet passes a predetermined length (for example 10 mm), the motor Ml starts to rotate in reverse to drive the separation roller 41. The reverse drive rotation is not transmitted because the supply roller 40 is connected to the one-way clutch 45*a*. The reverse rotational drive of the motor M1 is transmitted to the eccentric cam 43 via the belt 46*a* and the one-way clutch 45*b*. The eccentric cam 43 rotates to pressingly move the separation roller support member 44 in the direction of the arrow X. Doing this separates the separation roller 41 from the supply roller 40.

The following describes the spacing mechanism of the resister rollers 42 which are the second drive means that comprise the second spacing means.

Figure 11A:
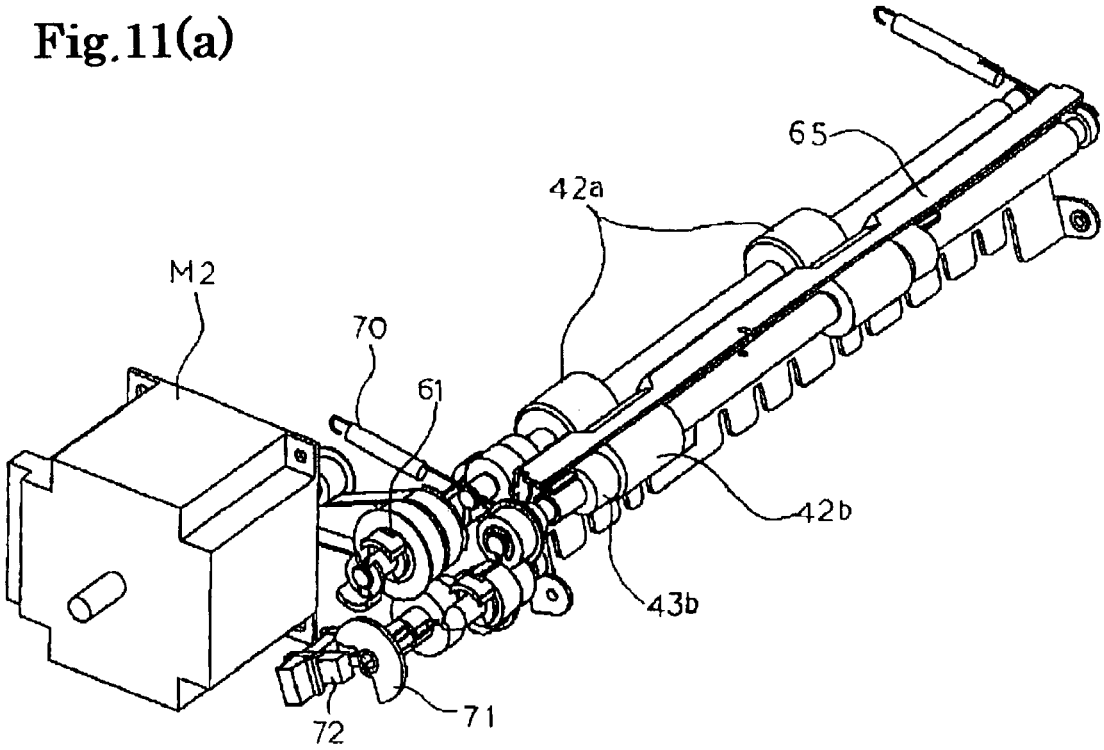
FIG. 11(*a*) and FIG. 11(*b*) are perspective views showing a drive mechanism of the resister rollers, wherein FIG. 11(*a*) shows a pair of the resister rollers 42 in a nipped (pressing) state, and FIG. 11(*b*) shows the pair of the resister rollers 42 in a released (separated) state.
Figure 11B:
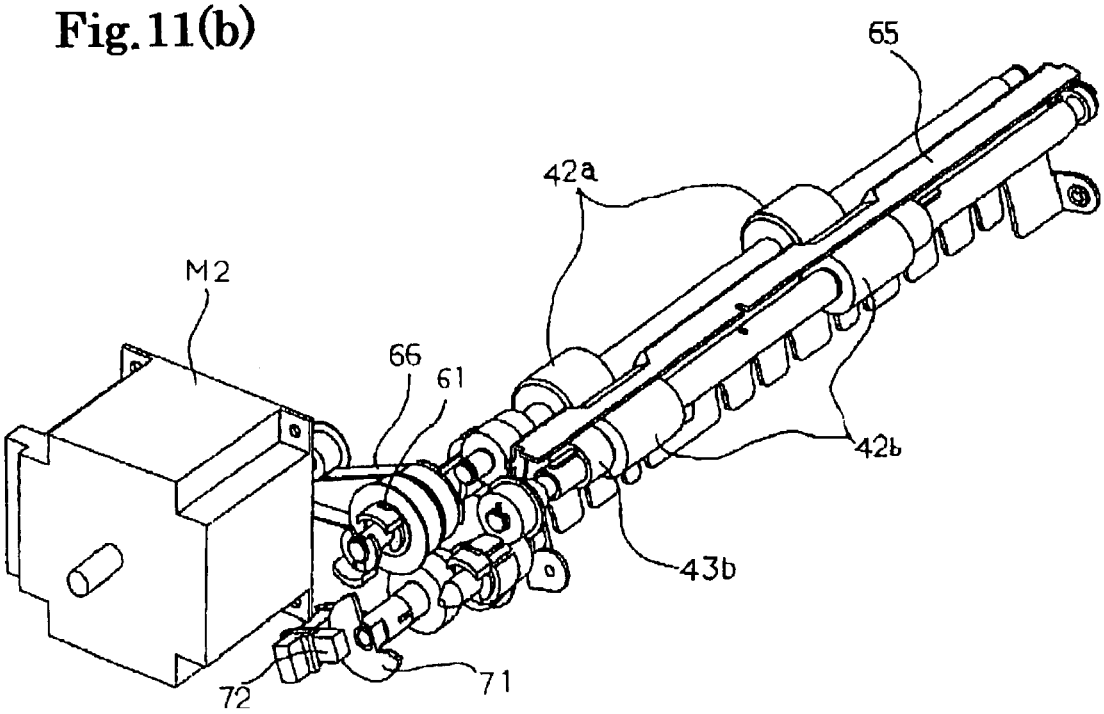

FIG. 11(*a*) and FIG. 11(*b*) are perspective views of the resister roller drive mechanism; FIG. 11(*a*) shows the resister rollers nipped and FIG. 11(*b*) shows the paired resister rollers 42 released. The second drive means comprises the resister motor M2 that rotates forward and in reverse to drive the resister rollers 42 and the separating means, the belt 66 that transmits the drive of the resister motor M2 to the resister rollers 42, the paired resister rollers 42*a* and 42*b* that align and transport the sheets to the main unit, the eccentric cam 43*b* for pressing and separation of the resister rollers 42, the guide plate 65 that guides the sheets and supports the eccentric cam, the spring 70 that urges the resister roller 42*b* to the pressing contact direction, and the sensor 72 and cam lug 71 that detect the release of the pressing of the resister rollers.

Figure 12A:
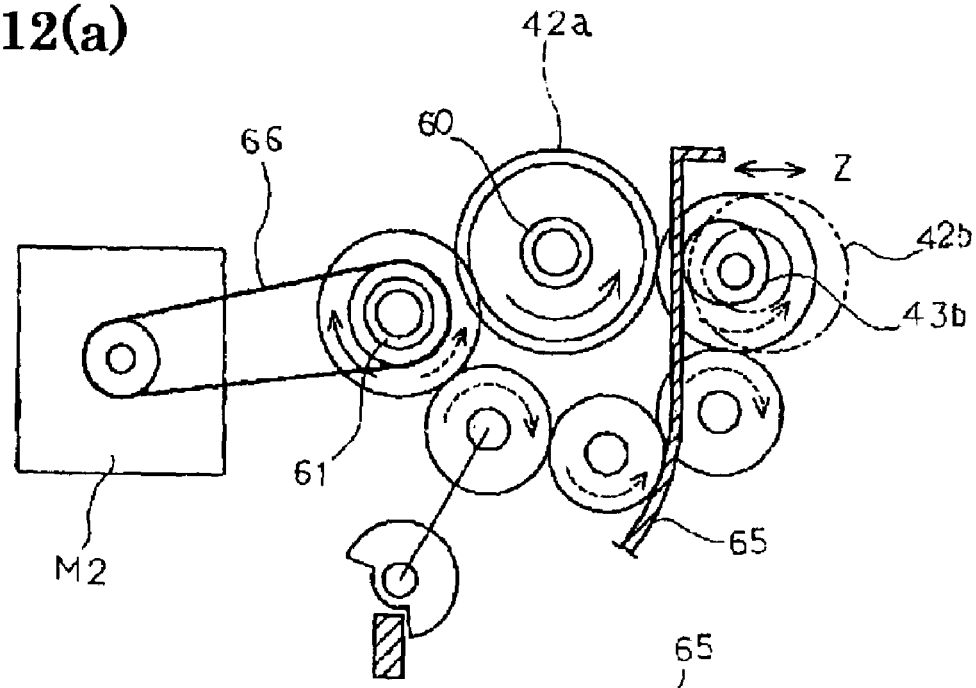
FIG. 12(*a*) and FIG. 12(*b*) show a separating drive mechanism of the resister rollers, wherein FIG. 12(*a*) is a side view of the separating drive mechanism of the resister rollers, and FIG. 12(*b*) is a plan view of FIG. 12(*a*)
Figure 12B:
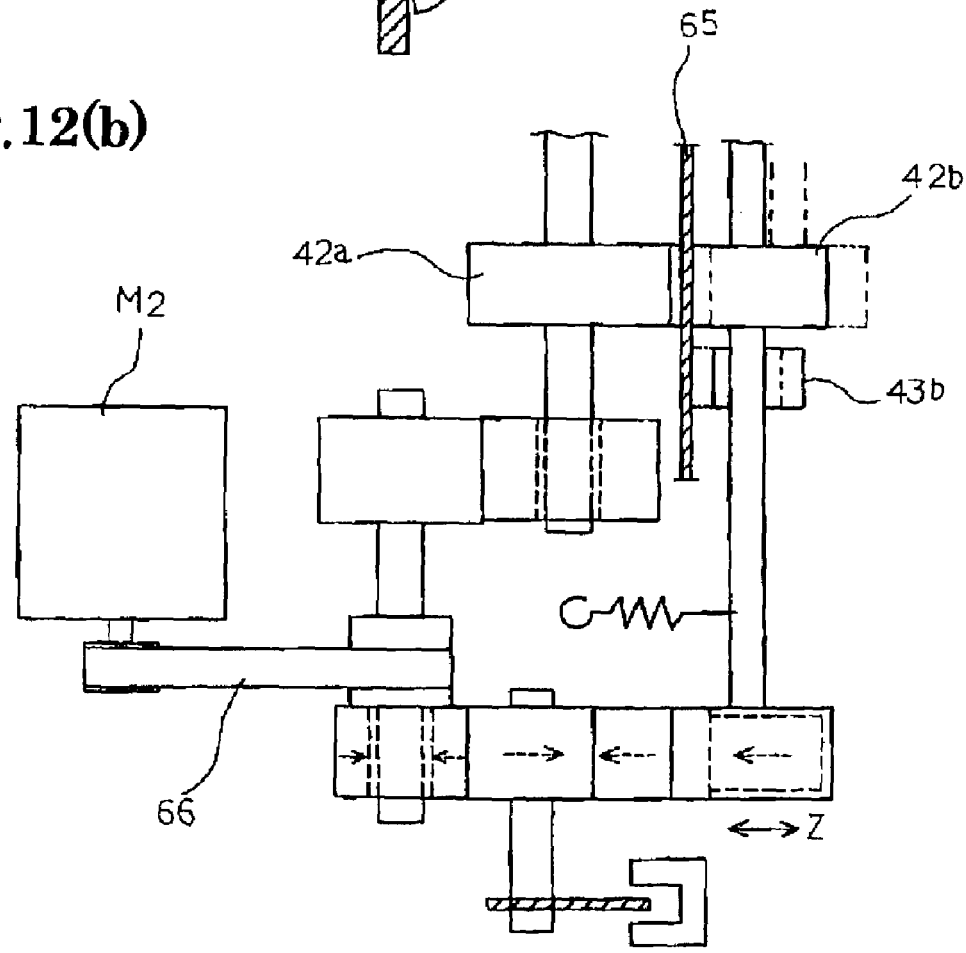
Figure 13:
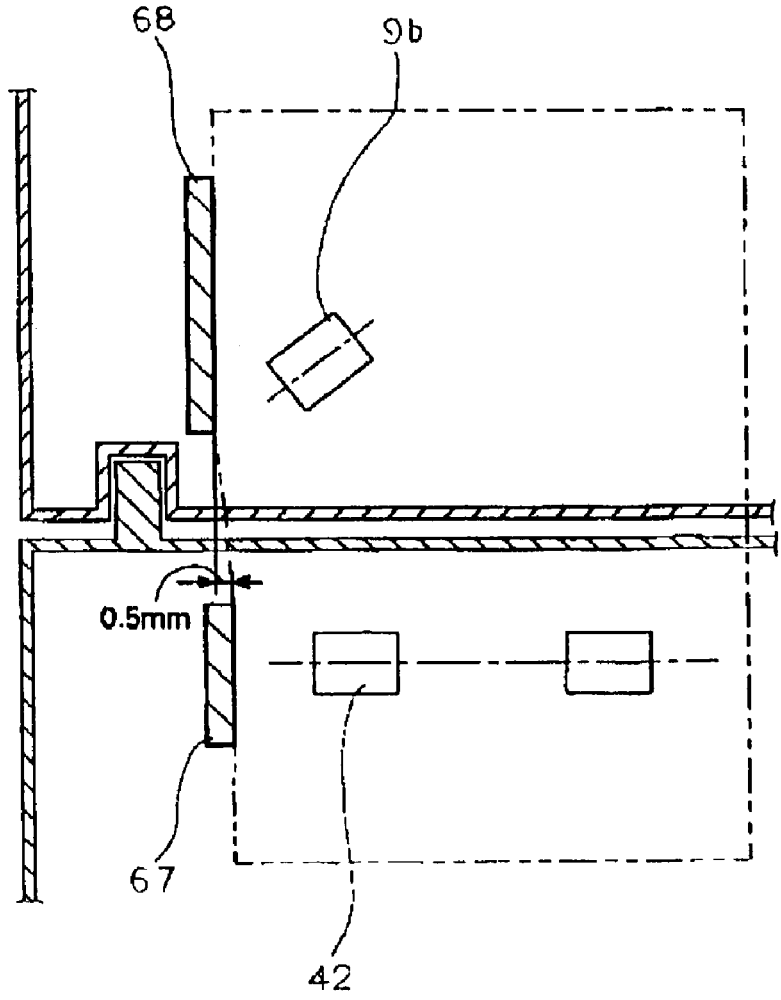
FIG. 13 is a plan view for explaining a transport reference for the resister rollers and the aligning rollers on the sheet supply apparatus side to transport the sheets.

FIG. 12(*a*) and FIG. 12(*b*) show the resister rollers 42 separating drive mechanism. FIG. 12(*a*) is a side view of the resister rollers 42 separating drive mechanism. FIG. 12(*b*) is a plan view of FIG. 12 (*a*). The sheet transported from the paired resister rollers 42 and nipped by the transport rollers 9 on the main unit side and alignment rollers 9*b* is sent by the alignment rollers 9*b* while one side is against the sheet supply reference. In this state, it compares the distance data previously received from the main unit and the transport distance and when it has determined that it has supplied the sheet the predetermined distance of the distance data, it starts rotating in reverse the resister motor M2. The resister rollers 42*a* are connected to the one-way clutch 60 so as not to rotate in reverse. The reverse rotational drive of the motor M2 is transmitted to the eccentric cam 43*b* via the belt 66 and the oneway clutch 61. The eccentric cam 43*b* rotates to pressingly move the guide plate 65 in the direction of the arrow Z. Doing this separates the resister roller 42*b* from the resister rollers 42*a*.

Furthermore, the sheet supply apparatus of the present invention is provided a means for moving and aligning the edge of sheets supplied from the resister rollers 42 to the transport reference 68 on the main unit apparatus.

In the sheet supply apparatus according to the present invention, the control apparatus comprises a control means for controlling the paired relay rollers (paired resister rollers 42) that supply sheets to the image forming apparatus main unit to press together and to separate according to the sheet size.

Figure 14A:
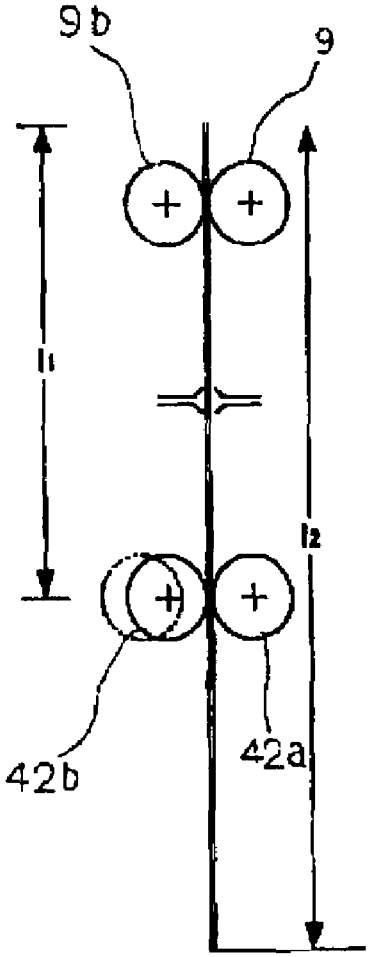
FIG. 14(*a*) to FIG. 14(*c*) are schematic drawings showing a state that the sheets with various sizes are supplied between the resister rollers and the aligning rollers.
Figure 14B:
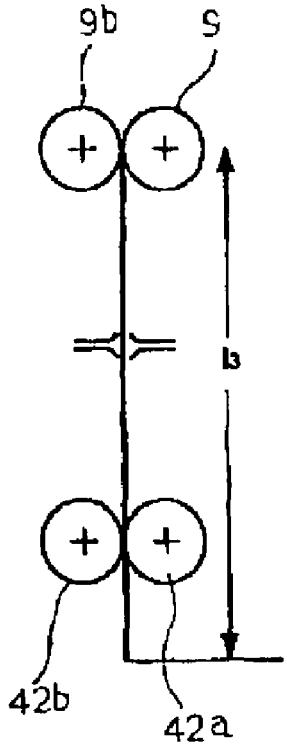
Figure 14C:
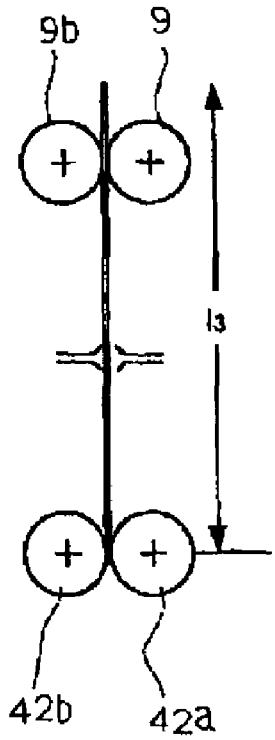

FIG. 14(*a*) to FIG. 14(*c*) show various sizes of sheets being supplied between the resister rollers 42 as the first transport rollers or the relay transport rollers and the aligning rollers 9*b* on the image forming apparatus main unit as the second transport rollers or the main unit image forming apparatus H side transport rollers.

In the present invention, the sheet supply apparatus 1 receives and stores the transport distance data L1 for the distance between the resister rollers 42 on the main unit apparatus H and the aligning rollers 9*b* on the main unit side when the power to the main unit apparatus H is turned on. The size data L2 for the sheets stacked in the cassette is detected by the sheet size detection sensor 20 which is established on the sheet supply apparatus. The size signal is sent and stored in the CPU 100. The CPU compares the transport distance between the resister rollers 42 and the main unit size aligning rollers 9*b* with the sheets length data from the sheet size detection sensor 20.

The resister rollers 42 are composed to transport the sheet the amount of the distance data and to separate according to the transport distance data of the sheet supply apparatus 1. In other words, if the distance data L1 is smaller than the sheet size L2, the resister rollers 42 separate. If the distance data L1 is larger than the sheet size L3, the resister rollers enter a sheet supply wait state and do not separate.

Also, if the transport distance data L1 between the resister rollers 42 and the main unit side aligning roller 9*b* is 210 mm+10 mm+α mm, the portrait length of the A5 size sheet is 210 mm, so the resister rollers 42 do not separate. B5 size sheets are 257 mm in the portrait direction and A4 size sheets are 297 mm in the portrait direction, so the resister rollers 42 separate when transporting sheets of these sizes.

Thus, when using sheets S with sizes longer than the distance (L1) between the resister rollers 42 and the aligning rollers 9*b*, the resister rollers 42 separate as shown in FIG. 14(*a*). However, as shown in FIG. 14(*b*) and FIG. 14(*c*), when using smaller sized sheets (L3), the resister rollers supply the sheet to the aligning roller 9*b* on the main unit, but when the leading edge of the sheet reaches the aligning roller, the trailing edge of the sheet exits the paired resister rollers 42. Even if the resister roller 42*b* do not separate, and the trailing edge of the sheet exists, there is no load of the sheet supply placed on the aligning rollers 9*b*. Later, it waits for the next supply signal and can start sheet supply again. The configuration of the present invention omits unnecessary roller spacing action when supplying small sheets quickly, to enable high speed sheet supply.

The following shall explain the flow charts to explain the operation to determine whether to space the resister rollers when starting the supply operation on the image forming apparatus H and the sheet supply apparatus 1.

Figure 15:
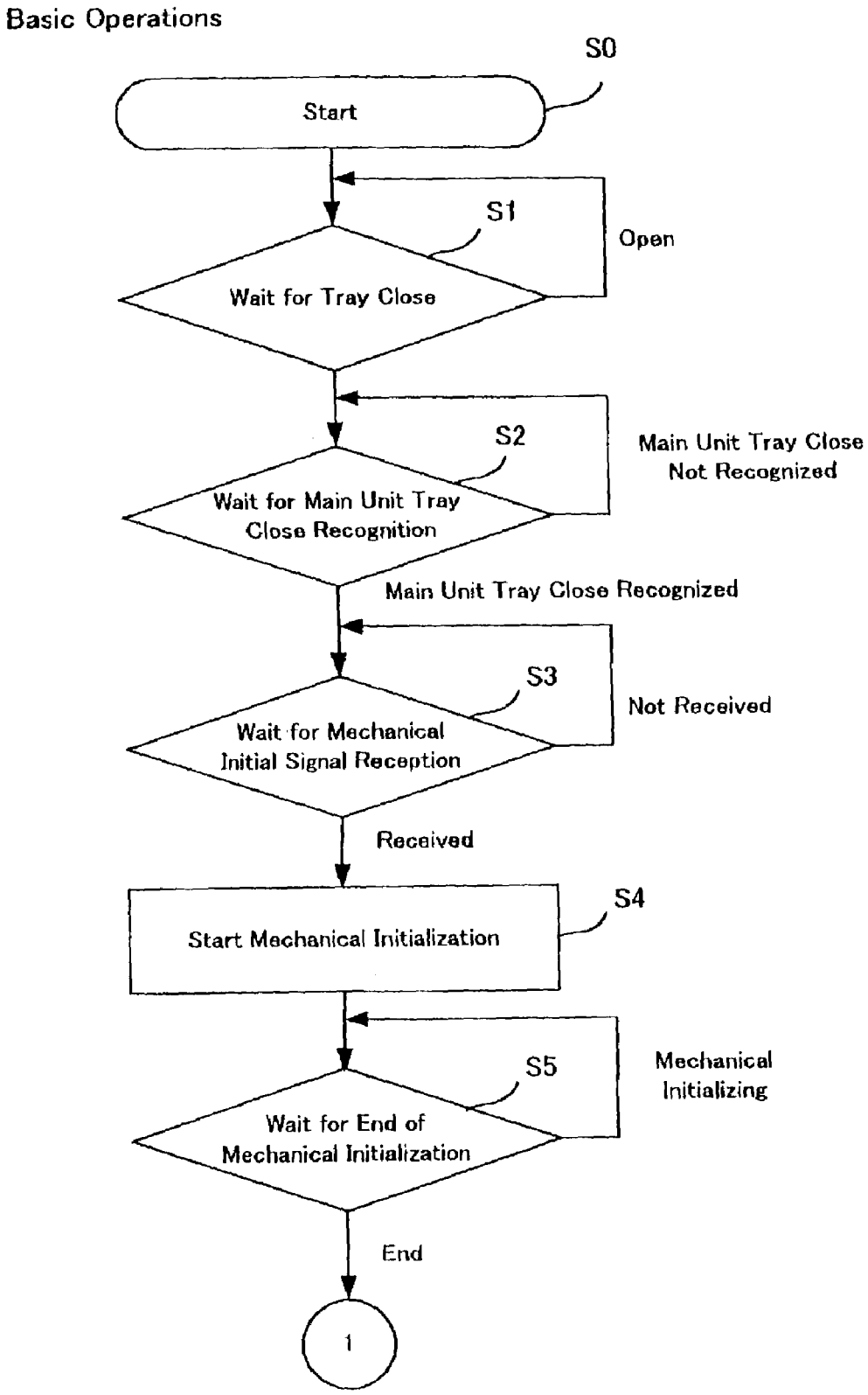
FIG. 15 is a flow chart showing a basic operation of starting to supply the sheets in the image forming apparatus and sheet supply apparatus.

FIG. 15 is a flow chart showing the basic operation to start sheet supply on the image forming apparatus H and the sheet supply apparatus 1.

The sheet supply apparatus 1 starts when the power is turned on to the main unit H (S0). It checks if the tray is closed (S1, S2), and if it is closed, it waits for the mechanical initializing signal (S3). When the mechanical initialize signal is received, the initialization process is started (S4). In this initialization process, the sheets are lifted to the idle position and the resister rollers 42 and separation roller 41 are returned to their home positions. In the operations to return them to their home positions, the rollers are rotated in the directions to press together and then to separate (reverse rotations to that of transport) and when the home position is detected by the encoder sensor, the operation stops the motor (S5).

Figure 16:
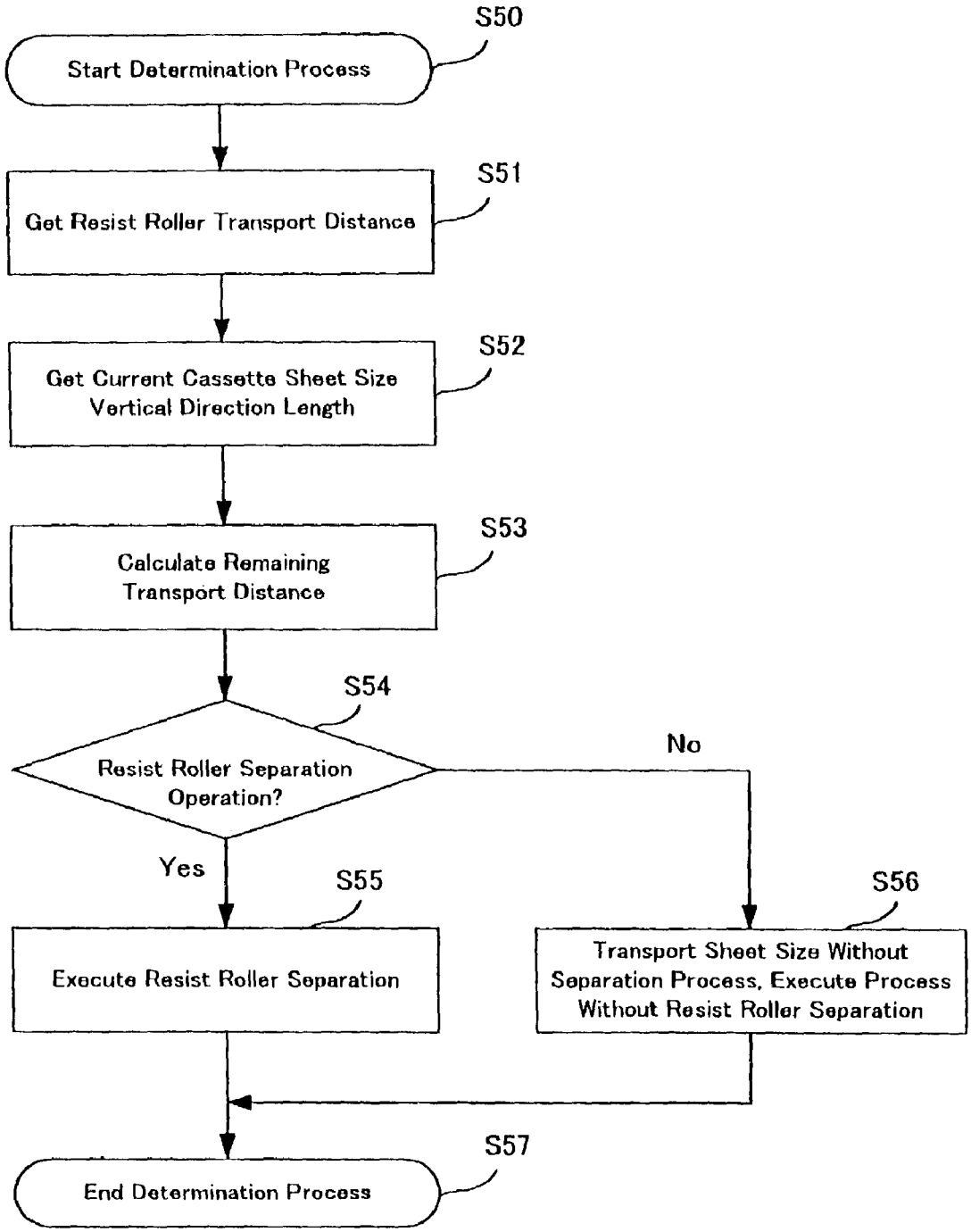
FIG. 16 is a flow chart showing a process to determine whether the resister rollers need to separate according to a size of the sheets.

FIG. 16 is a flowchart to show the process to determine the need to space the resister rollers 42. The power to the main unit H is turned on and the determining process is started when initializing (S50). The distance data from the cassette side resister rollers 42 to the main unit aligning rollers 9*b* is obtained (S51). The vertical direction length of the sheet size currently stacked in the cassette is obtained (S52). The distance of travel is calculated (S53). The result determines whether to nip or to separate the resister rollers 42 (S54). If the length of the sheet is longer than the distance between rollers+α (the distance data set as the predetermined distance), the resister rollers 42 execute the separation (S55). If the length of the sheet is shorter than the distance between the rollers+α, the resister rollers 42 do not separate and the sheet is supplied for its size.

As described in detail above, the present invention provides a sheet transport apparatus that is equipped with the first transport rollers, the second transport rollers arranged downstream of the aforementioned first transport rollers to receive a sheet transported from the aforementioned first transport rollers, the separating means for setting the aforementioned first transport rollers to a sheet nipping state or to a sheet released state, the sheet detection means for detecting the sheet length in the transport direction of transported sheets, and the comparing means for comparing the sheet length detected by the aforementioned sheet detection means and the preset sheet length, and that is controlled to activate the aforementioned spacing means after the aforementioned sheet is transported a predetermined length when the result of the comparison is that the aforementioned sheet length is longer than the aforementioned predetermined length to activate the aforementioned first transport rollers from a sheet nipping state to a sheet released state, and to maintain the aforementioned first transport rollers in a sheet nipping state when the aforementioned sheet length is shorter than the aforementioned predetermined length.

Through this, the invention provides an apparatus that makes sheet alignment downstream simpler and realizes high speed sheet supply because it controls to activate the transport rollers from the sheet nipping state to the sheet released state or to maintain the sheet nipping state according to the length of the sheet being transported. Furthermore, the smooth feeding of sheets to the aligning means to align sheets determined on the sheet transport reference in the sheet transport direction from the sheet supply apparatus is possible with a simple mechanism.

What is claimed is:

1. A sheet supply apparatus comprising:

a pair of transport rollers for transporting sheets, a sheet transport reference arranged downstream of the pair of the transport rollers to extend along a transport direction of the sheet, an aligning roller disposed adjacent to the sheet transport reference, said aligning roller receiving the sheet transported from the pair of the sheet transport rollers and transporting the sheet to the sheet transport reference to align the sheet, spacing means for setting the pair of the transport rollers to be in one of a sheet nipping state and a sheet released state, sheet detection means for detecting a length of the sheet in the transport direction, and comparing means for comparing the length of the sheet detected by the sheet detecting means with a length between the pair of the sheet transport rollers and the aligning roller, wherein when said comparison means determines that the sheet has a length longer than the length between the pair of the sheet transport rollers and the aligning roller, said spacing means is activated to set the pair of the sheet transport rollers from the sheet nipping state to the sheet released state after the sheet is transported by a predetermined distance, and when the sheet has a length shorter than the length between the pair of the sheet transport rollers and the aligning roller, said spacing means is activated to hold the pair of the sheet transport rollers in the sheet nipping state.

2. A sheet supply apparatus detachably mounted to an image forming apparatus with sheet transport means for drawing and supplying stacked sheets, comprising:

separating means for separating the sheets on a sheet supply path, a pair of relay transport rollers for transporting the sheets supplied from the separating means to the sheet transport means disposed in the image forming apparatus, release means for reducing or releasing a pressure of nipping the sheets of the pair of the relay transport rollers, a motor capable of rotating in forward and reverse directions, said motor being connected to the relay transport rollers for rotating the relay transport rollers to transport the sheet when the motor rotates in the forward direction and actuating the release means to reduce or release the pressure of nipping the sheets of the relay transport rollers when the motor rotates in the reverse direction, sheet detection means for detecting a length of the sheets in a transport direction, comparing means for comparing the length of the sheets detected by the sheet detecting means with a predetermined length, and control means for determining whether the motor rotates in the reverse direction to actuate the release means according to a result of the comparing means.

3. A sheet supply apparatus according to claim 2, wherein said motor rotates in the reverse direction to actuate said release means to switch the pair of the relay transport rollers from the sheet nipping state to the sheet released state after the sheet is transported by a predetermined distance when the sheet has a length longer than the predetermined length based on the result of the comparing means, and said release means is controlled to activate to hold the pair of the relay transport rollers in the sheet nipping state when the sheet has a length shorter than the predetermined length.

4. A sheet supply apparatus according to claim 2, wherein said predetermined length is set based on a distance from the pair of the relay transport rollers to an aligning roller in the image forming apparatus, and said pair of the relay transport rollers is controlled to activate from the sheet nipping state to the sheet released state after the sheet is supplied to the aligning roller.

5. A sheet supply apparatus for supplying sheets to an image forming apparatus having aligning means for aligning the sheets at a side of a predetermined sheet transport reference in a sheet transport direction, comprising:

sheet storage means capable of ascending and descending for storing the sheets, sheet pick-up means for picking up the sheets in the sheet storage means, separating means composed of a supply roller for supplying the sheets picked up from the sheet pick-up means and a separating member for pressing against the supply roller, a pair of relay rollers for transporting the sheets separated and transported by the separating means in the transport direction at a downstream side in a sheet supply path, first drive means comprising first spacing means, said first drive means rotating the supply roller in the transport direction with forward rotation and setting the supply roller and the separating members to one of a sheet nipping state and a sheet released state with reverse rotation, second drive means comprising second spacing means, said second drive means rotating the pair of the relay rollers in the sheet transport direction with forward rotation and setting the pair of the relay rollers to one of a sheet nipping state and a sheet released state with reverse rotation, sheet detection means for detecting a length of the sheet in the transport direction, memory means for storing transport distance data from the pair of the relay rollers to a position where the aligning means can transport the sheet, and comparing means for comparing the length of the sheet detected by the sheet detecting means with the transport distance data so that said second drive means is controlled to switch from the forward rotation to the reverse rotation based on a comparison result of the comparing means.

6. A sheet supply apparatus according to claim 5, wherein said second spacing means is controlled to activate to switch the pair of the relay rollers from the sheet nipping state to the sheet released state when the sheet has a length longer than the transport distance data based on the result of the comparing means, and said second spacing means is controlled to activate to hold the pair of the relay rollers in the sheet nipping state when the sheet has a length shorter than a predetermined length.

7. A sheet supply apparatus according to claim 5, wherein said first spacing means is controlled to activate to set the pair of the supply rollers and the separating members in the sheet released state after a leading edge of the supplied sheet reaches the pair of the transport rollers.

* * * * *